US006810544B1

(12) United States Patent
Smith

(10) Patent No.: US 6,810,544 B1
(45) Date of Patent: Nov. 2, 2004

(54) TRANSPORTABLE LEG SUPPORT

(76) Inventor: Trintus T. Smith, 5226 Candlelight Dr., Davenport, IA (US) 52086

( * ) Notice: Subject to any disclaimer, the term of this patent is extended or adjusted under 35 U.S.C. 154(b) by 0 days.

(21) Appl. No.: 10/402,060

(22) Filed: Mar. 27, 2003

(51) Int. Cl.[7] ..... A47C 17/86

(52) U.S. Cl. ..... 5/648; 5/630; 297/423.35; 297/423.28

(58) Field of Search ..... 5/630, 648–651, 5/646, 647; 297/423.35, 423.28, 423.26

(56) References Cited

U.S. PATENT DOCUMENTS 2,502,752 A * 4/1950 Richards ..... 5/648
2,509,086 A * 5/1950 Eaton ..... 5/640
2,630,288 A * 3/1953 Eubanks, Sr. ..... 5/648
2,722,692 A * 11/1955 Dempster ..... 5/648
2,785,418 A * 3/1957 Goguen ..... 5/648
2,914,116 A * 11/1959 Gohmann ..... 5/648
3,104,446 A * 9/1963 Throop, Jr. ..... 5/648
4,681,309 A * 7/1987 Lechner ..... 269/328
4,922,558 A * 5/1990 Porco ..... 397/391
5,054,144 A * 10/1991 Stuart et al. ..... 297/423.44
5,111,808 A * 5/1992 Meals ..... 5/648
5,467,490 A * 11/1995 Rice ..... 5/636
6,221,036 B1 * 4/2001 Lucas ..... 5/648

* cited by examiner

*Primary Examiner*—Teri Pham Luu
(74) *Attorney, Agent, or Firm*—Donald J. Ersler

(57) ABSTRACT

A transportable leg support includes a first leg support, a second leg support and a connection strap. The first leg support includes a first upper member pivotally connected to a first lower member. The second leg support includes a second upper member pivotally connected to a second lower member. One end of the connection strap is attached to one end of the first upper member and the other end of the connection strap is attached to one end of the second upper member. The length of the connection strap is preferably adjustable to accommodate individuals having different width posteriors. A first foot support is attached to an end of the first lower member and the second foot support is attached to an end of the second lower member.

14 Claims, 4 Drawing Sheets

TRANSPORTABLE LEG SUPPORT

BACKGROUND OF THE INVENTION

1. Field of the Invention

The present invention relates generally to leg supports and more specifically to a transportable leg support, which may be used when a person is sitting or lying down.

2. Discussion of the Prior Art

It appears that the prior art does not disclose a transportable leg support. The state-of-the-art teaches leg supports rigidly attached to chairs of different types and leg braces for controlling motion of a leg. However, these devices do not teach or suggest the transportable leg support.

Accordingly, there is a clearly felt need in the art for a transportable leg support, which may be used on a chair without an integral leg support or used when a person is lying down to elevate one or both legs.

SUMMARY OF THE INVENTION

The present invention provides a transportable leg support, which may be used when a person is sitting or lying down. The transportable leg support includes a first leg support, a second leg support and a connection strap. The first leg support includes a first upper member, a first lower member and a first foot support. The second leg support includes a second upper member, a second lower member and a second foot support. One end of the connection strap is attached to one end of the first upper member and the other end of the connection strap is attached to one end of the second upper member. The length of the connection strap is preferably adjustable to accommodate individuals having different width posteriors. The other end of the first upper member is pivotally connected to one end of the first lower member. The other end of the second upper member is pivotally connected to one end of the second lower member. The first foot support is attached to the other end of the first lower member and the second foot support is attached to the other end of the second lower member.

Accordingly, it is an object of the present invention to provide a transportable leg support, which may be used on a chair without an integral leg support or used when a person is lying down to elevate one or both legs.

These and additional objects, advantages, features and benefits of the present invention will become apparent from the following specification.

DETAILED DESCRIPTION OF THE PREFERRED EMBODIMENTS

Figure 1:
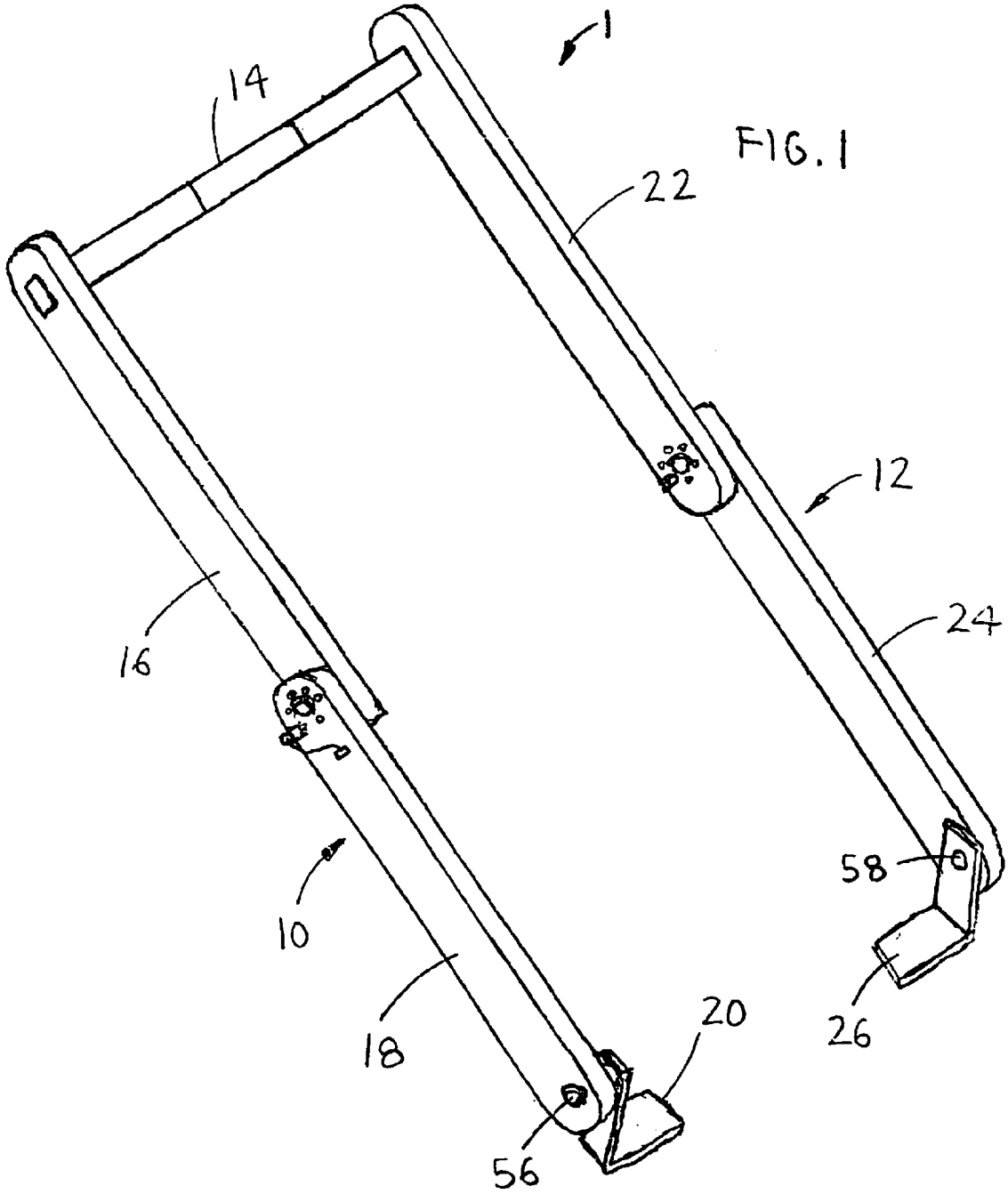
FIG. 1 is a perspective view of a transportable leg support in accordance with the present invention.
Figure 2:
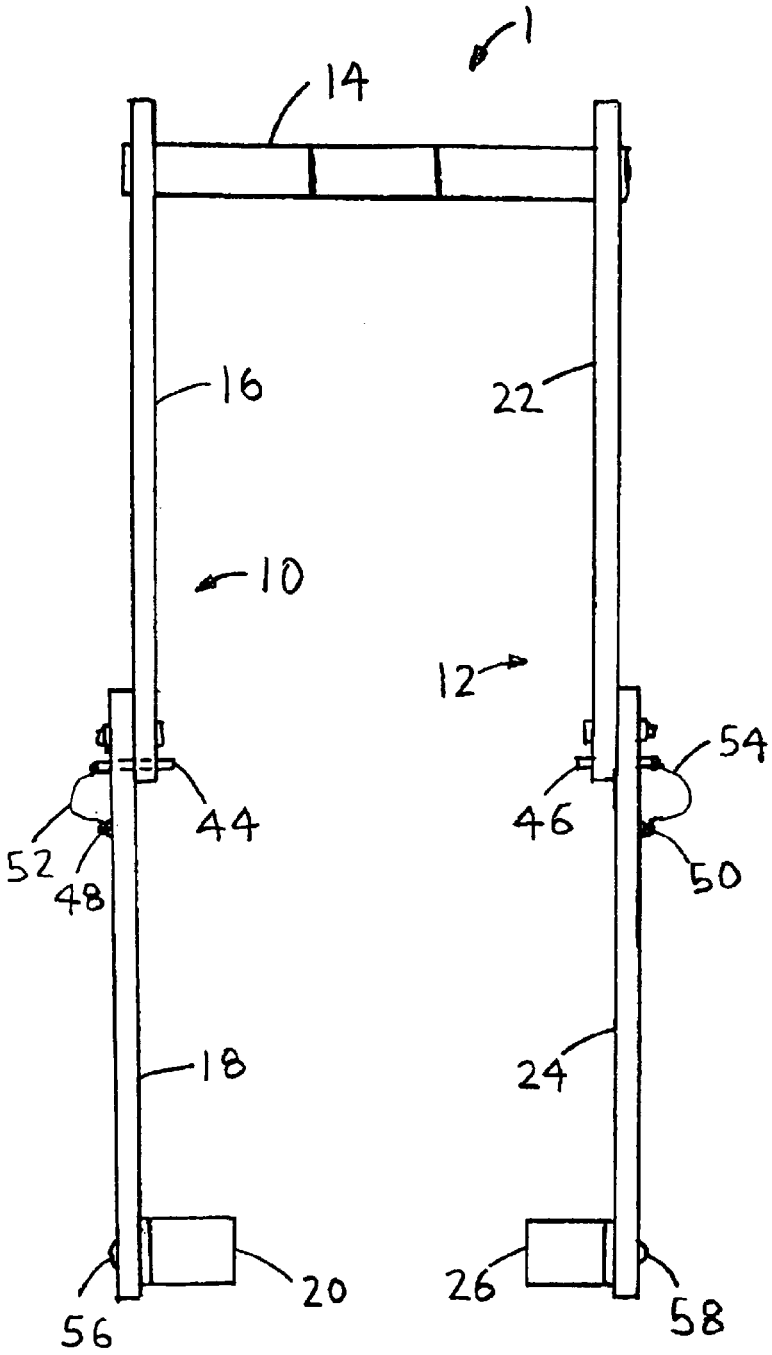
FIG. 2 is a top view of a transportable leg support in accordance with the present invention.
Figure 4:
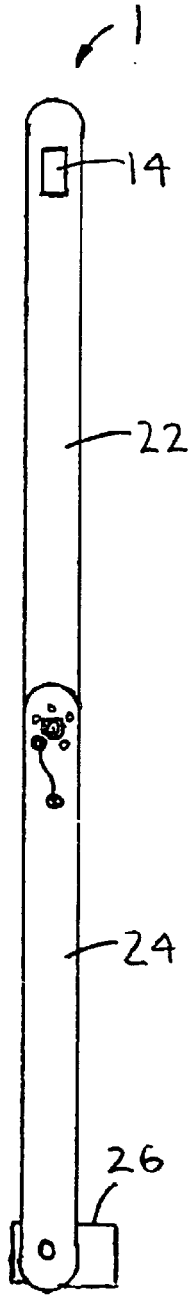
FIG. 4 is a side view of a transportable leg support in accordance with the present invention.
Figure 3:
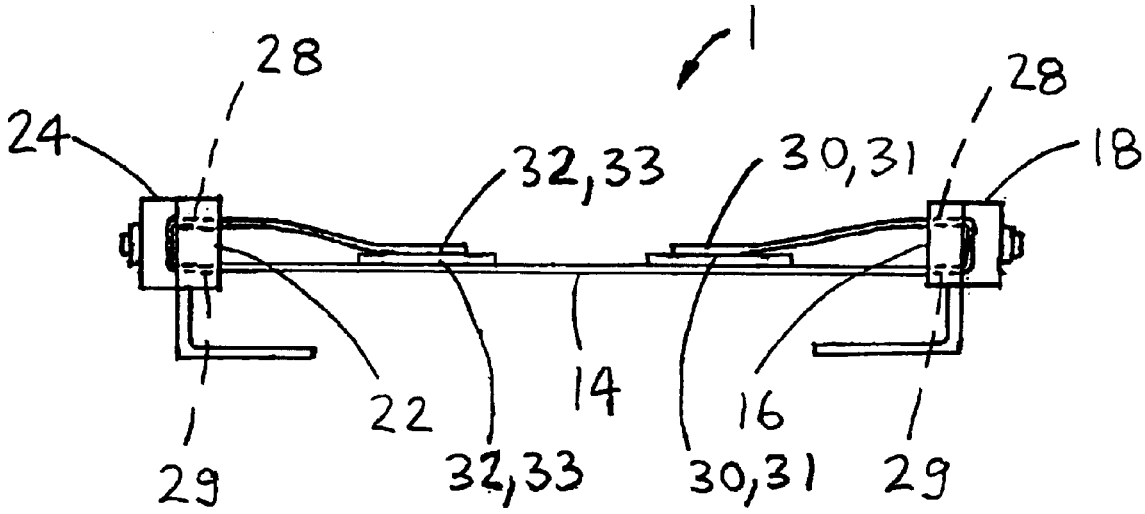
FIG. 3 is a rear end view of a transportable leg support in accordance with the present invention.
Figure 7:
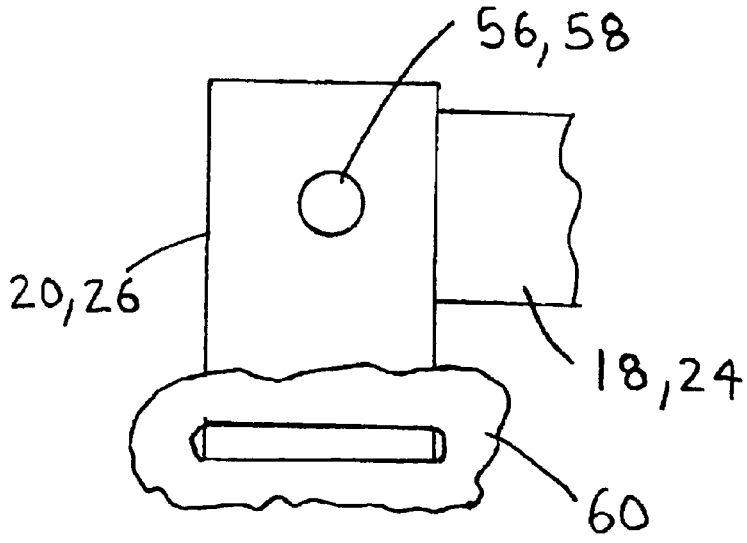
FIG. 7 is a front view of a foot support with a piece of padding applied thereto of a transportable leg support in accordance with the present invention.

With reference now to the drawings, and particularly to FIG. 1, there is shown a perspective view of a transportable leg support 1. With reference to FIGS. 2–4, the transportable leg support 1 includes a first leg support 10, a second leg support 12 and a connection strap 14. The first leg support 10 includes a first upper member 16, a first lower member 18 and a first foot support 20. The second leg support 12 includes a second upper member 22, a second lower member 24 and a second foot support 26. One end of the connection strap 14 is preferably inserted through a first strap slot 28 and a second strap slot 29 in one end of the first upper member 16. The other end of the connection strap 14 is preferably inserted through a first strap slot 28 and a second strap slot 29 in one end of the second upper member 22. The connection strap 14 is preferably fabricated from leather, but could be fabricated from any other suitable material. Other methods of retaining the first leg support 10 relative to the second leg support 12 may also be used, besides the connection strap 14. The first upper member 16, second upper member 22, first lower member 18 and second lower member 24 may be fabricated from wood, plastic, aluminum or any other suitable material.

Preferably, the distance between the first and second leg supports is adjustable to accommodate individuals having different width posteriors. The adjustability of the connection strap 14 is preferably implemented by securing each end of the connection strap 14 to itself with first and second hook and loop fasteners. A first hook fastener 30 or a first loop fastener 31 is attached to one end of the connection strap 14 or to substantially a middle of the connection strap 14. A second hook fastener 32 or a second loop fastener 33 attached to one end of the connection strap 14 or to substantially a middle of the connection strap 14. The first hook fastener 30 is pressed against the first loop fastener 31 and the second hook fastener 32 is pressed against the second loop fastener 33 to secure the connection strap 14 to itself. Hook and loop fasteners are commonly sold under the registered trademark of "Velcro". However, other methods of securing the connection strap 14 to itself may also be used.

Figure 5:
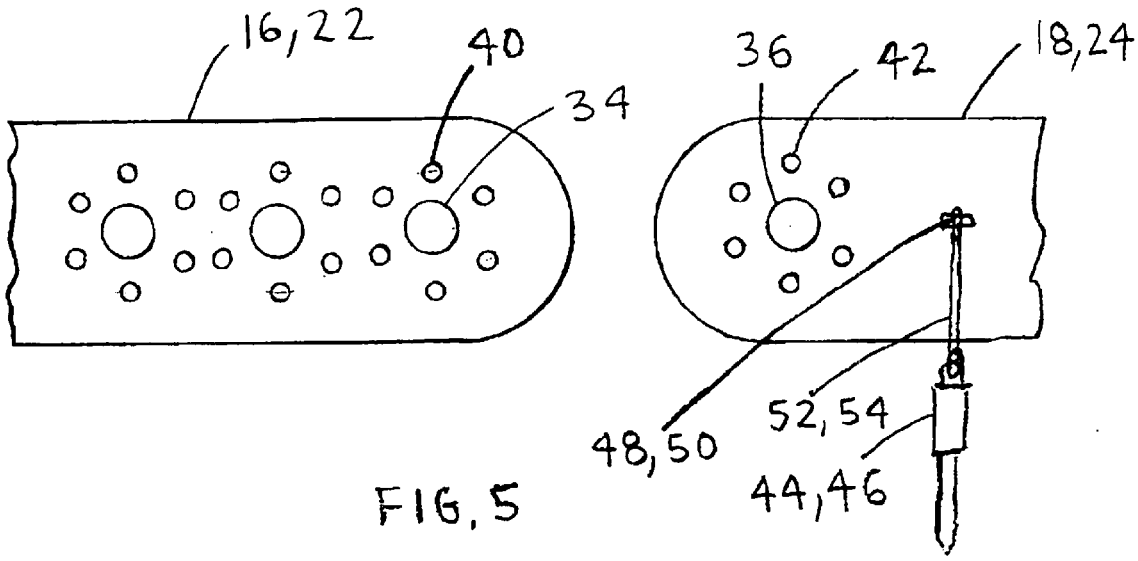
FIG. 5 is an enlarged side view of the other end of an upper member and one end of a lower member of a transportable leg support in accordance with the present invention.
Figure 6:
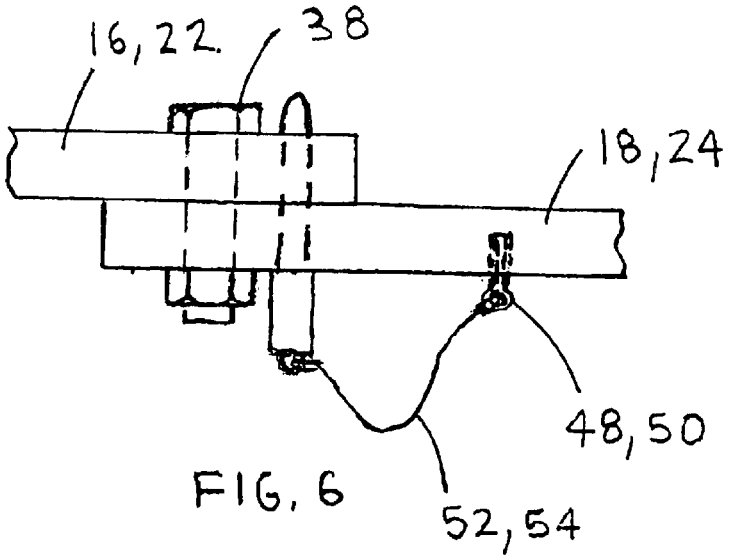
FIG. 6 is an enlarged top view of a junction of an upper member and a lower member of a transportable leg support in accordance with the present invention.

With reference to FIGS. 5 and 6, at least one pivot hole 34 is formed through the other end of the first and second upper members. Three pivot holes 34 are shown in the first and second upper leg members to enable the length of the first and second supports to be adjustable. At least one pivot hole 36 is formed through one end of the first and second lower members. A fastener is inserted through the pivot holes 34, 36 to pivotally retain the first upper member 16 relative to the first lower member 18 and the second upper member 22 relative to the second lower member 24. The angular position of the upper members relative to the lower members is preferably implemented with a plurality of upper locking holes 40 formed through the upper members 16, 22 and a plurality of lower locking holes 42 formed through the lower members 18, 24.

A first locking pin 44 is preferably inserted through a single upper and lower locking hole to secure the angular orientation of the first upper member 16 to the first lower member 18. A second locking pin 46 is preferably inserted through a single second upper and lower locking hole to secure the angular orientation of the second upper member 22 to the second lower member 24. The first locking pin 44 is preferably retained on the first lower member 22 with a first eye bolt 48 and a first wire 52. The second locking pin 46 is preferably retained on the second lower member 24 with a second eye bolt 50 and a second wire 54. However, other methods of locking the angular position of the upper members relative to the lower members, may also be used.

The first foot support 20 is pivotally attached to the other end of the first lower member 18 with a first fastener 56 or the like. The second foot support 26 is pivotally attached to the other end of the second lower member 24 with a second fastener 58 or the like. The first and second foot supports are disclosed as having an "L" shape, but other foot supports designs may also be used. The first and second foot supports are preferably modifiable to support ankles of a user. Accommodation for ankles is required when a person lying down, wants to raise their legs. Padding 60 may be attached to the first and second foot supports to cushion contact between ankles or feet of the user. Other methods of accommodating ankles may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A transportable leg support, comprising:

a first leg support having a first upper member pivotally attached to a first lower member, a first foot support being pivotally attached to an end of said first lower member;

a second leg support having a second upper member pivotally attached to a second lower member, a second foot support being pivotally attached to an end of said second lower member; and means for retaining said first leg support relative to said second leg support.

2. The transportable leg support of claim 1, further comprising:

said means for retaining being a connection strap with one end secured to said first upper member and the other end secured to said second upper member.

3. The transportable leg support of claim 2, further comprising:

one of a hook fastener and a loop fastener being attached to each end of said connection strap and one of a loop fastener and a hook fastener being attached to substantially a middle of said connection strap.

4. The transportable leg support of claim 2, further comprising:

at least one first strap slot being formed through said first upper member to receive one end of said connection strap and at least one second strap slot being formed through said second upper member to receive the other end of said connection strap.

5. The transportable leg support of claim 1, further comprising:

a plurality of first locking holes being formed through said first upper member and said first lower member, said plurality of first locking holes being sized to receive a first locking pin; and a plurality of second locking holes being formed through said second upper member and said second lower member, said plurality of second locking holes being sized to receive a second locking pin.

6. A transportable leg support, comprising:

a first leg support having a first upper member pivotally attached to a first lower member, a first foot support being pivotally attached to an end of said first lower member;

a second leg support having a second upper member pivotally attached to a second lower member, a second foot support being pivotally attached to an end of said second lower member; and a connection strap with one end secured to said first upper member and the other end secured to said second upper member.

7. The transportable leg support of claim 6, further comprising:

a plurality of first locking holes being formed through said first upper member and said first lower member, said plurality of first locking holes being sized to receive a first locking pin; and a plurality of second locking holes being formed through said second upper member and said second lower member, said plurality of second locking holes being sized to receive a second locking pin.

8. The transportable leg support of claim 7, further comprising:

at least one first strap slot being formed through said first upper member to receive one end of said connection strap and at least one second strap slot being formed through said second upper member to receive the other end of said connection strap.

9. The transportable leg support of claim 6, further comprising:

one of a hook fastener and a loop fastener attached to each end of said connection strap and one of a loop fastener and a hook fastener attached to substantially a middle of said connection strap.

10. A transportable leg support, comprising:

a first leg support having a first upper member pivotally attached to a first lower member, a first foot support being pivotally attached to an end of said first lower member;

a second leg support having a second upper member pivotally attached to a second lower member, a second foot support being pivotally attached to an end of said second lower member; and a connection strap having one end secured to said first upper member and the other-end secured to said second upper member, a width between said first and second leg supports being adjustable with said connection strap.

11. The transportable leg support of claim 10, further comprising:

means for securing the angular orientation of said first upper member relative to said first lower member; and means for securing the angular orientation of said second upper member relative to said second lower member.

12. The transportable leg support of claim 11, further comprising:

said means for securing the angular orientation of said first upper member being a plurality of first locking holes formed through said first upper member and said first lower member, said plurality of first locking holes being sized to receive a first locking pin; and said means for securing the angular orientation of said second upper member being a plurality of second locking holes formed through said second upper member and said second lower member, said plurality of second locking holes being sized to receive a second locking pin.

13. The transportable leg support of claim 10, further comprising:

at least one first strap slot being formed through said first upper member to receive one end of said connection strap and at least one second strap slot being formed through said second upper member to receive the other end of said connection.

14. The transportable leg support of claim 10, further comprising:

said width being adjustable between said first and second leg supports with one of a hook fastener and a loop fastener attached to each end of said connection strap and one of a loop fastener and a hook fastener attached to substantially a middle of said connection strap.

* * * * *